United States Patent [19]

Yashin et al.

[11] 4,236,065

[45] Nov. 25, 1980

[54] SELF-REGULATING ELECTRIC HEATER

[75] Inventors: Michael A. Yashin, Foxboro, Mass.; Lucilio A. Rebelo, Pawtucket, R.I.

[73] Assignee: Texas Instruments Incorporated, Attleboro, Mass.

[21] Appl. No.: 966,837

[22] Filed: Dec. 6, 1978

[51] Int. Cl.[3] ..... H05B 3/02

[52] U.S. Cl. ..... 219/544; 219/505; 219/540; 219/541; 219/552; 338/22 R; 338/23; 338/274; 174/52 PE

[58] Field of Search ..... 219/504, 505, 536, 541, 219/523, 544, 552, 553; 338/22 R, 22 SD, 23, 274, 316; 310/68 C; 174/16 HS, 52 PE

[56] References Cited

U.S. PATENT DOCUMENTS

| | | | |
|---|---|---|---|
| 3,794,949 | 2/1974 | Larson et al. | 338/22 R |
| 3,885,129 | 5/1975 | Fabricius | 219/553 |
| 3,940,591 | 2/1976 | Ting | 219/544 |
| 3,958,208 | 5/1976 | Blaha | 338/22 R |
| 3,996,447 | 12/1976 | Bouffard | 219/541 |
| 4,045,763 | 8/1977 | Miyamoto | 338/23 |
| 4,086,467 | 4/1978 | Grant | 219/544 |
| 4,091,267 | 5/1978 | Grant | 219/544 |
| 4,147,927 | 4/1979 | Pirotte | 219/541 |

*Primary Examiner*—Volodymyr Y. Mayewsky

*Attorney, Agent, or Firm*—John A. Haug; James P. McAndrews; Melvin Sharp

[57] ABSTRACT

A self-regulating electric heater particularly useful for heating compressor lubricant and the like is disclosed in which a cylindrical body of electrically insulative ceramic is formed with an axially extending generally parallelepiped shaped slot in communication with an end of the body. A positive temperature coefficient of resistivity (PTC) resistor, configured slightly smaller and complementary with the slot, is disposed therein. Axially extending grooves are formed in two opposed parallel walls of the body which, with two other cooperating walls, define the slot. The grooves are located on opposite sides of an axial plane perpendicular to the opposed walls. A platform is formed in each groove to serve as a stop surface to limit the insertion of spring biased terminals which are inserted in the grooves to provide electrical connection with the PTC resistor. The grooves are coextensive in length with the slot to permit reception of an injection nozzle to facilitate injection of thermal transfer material from the inside of the device to the outside to obviate trapping of air pockets. Finally, sealant material is disposed in the open end of the body with the terminal leads extending therethrough.

5 Claims, 4 Drawing Figures

SELF-REGULATING ELECTRIC HEATER

BACKGROUND AND SUMMARY OF INVENTION

This invention relates in general to self-regulating heaters and more specifically to PTC ceramic heater devices particularly suitable for heating compressor oil.

In conventional refrigeration compressors, a refrigerant, such as one sold under the trademark "Freon" by E. I. Du Pont de Nemours, & Co., under certain temperature conditions tends to migrate from the condenser into the compressor lubricant. Such migration is undesirable since it causes deleterious effects including the reduction in lubricating properties of the lubricant. In order to avoid this problem it is conventional to employ a crankcase heater to maintain the compressor crankcase at a temperature above that of the rest of the refrigeration system which has the effect of boiling out any Freon already in the lubricant and of preventing migration of the refrigerant into the crankcase lubricant. Recently, improvements have been effected in these heaters making them self-regulating, thus improving their reliability while doing away with the costs involved in associated regulation controls. By way of example: U.S. Pat. Nos. 3,564,199; 3,720,807; 3,748,439; 3,824,328; 3,940,591; 3,996,447; 4,086,467; and 4,091,267 all disclose self-regulating heaters useful in many applications including the heating of compressor crankcases. These devices employ a heater made of ceramic material having a positive temperature coefficient (PTC) of resistivity. Such heaters have a relatively low resistance at normal ambient temperatures, but following energization by a source of electric power will self heat and increase in temperature and resistance. Once a threshold or anomaly temperature is reached the resistance increases rapidly by several orders of magnitude and will stabilize when the heat generated balances the heat dissipated. At this point the resistance level is many times the initial room temperature value.

While the heaters of the above mentioned patents are effective for many applications, it is an object of the present invention to provide a self-regulating heater and a method for making such a heater, which is more conducive to mass production assembly techniques than prior art devices. Another object is the provision of a self-regulating heating device which uses a minimal number of components and thus can be produced at a low cost while still producing such heaters which are reliable and efficient.

The self-regulating heater of this invention preferably comprises a cylindrical body of steatite or other electrically insulative ceramic in which a slot of parallelepiped configuration is formed extending in an axial direction from an open end toward a closed end of the cylindrical body. A single PTC resistor, formed of ceramic material such as a doped barium titanate, is configured slightly smaller than and complementary with the slot and is received therein. In two of the walls defining the slot, an axially extending groove is formed coextensive in length with the slot. Intermediate the ends of the groove a platform is formed in the body to serve as a stop surface to limit the extent that a spring biased terminal can be inserted. Insertion of the terminals in the grooves place them in electrical connection with spaced portions of the PTC resistor. The grooves are disposed on opposite sides of a plane in which the longitudinal axis of the cylinder lies and which is perpendicular to the walls in which the grooves are formed in order to optimize spacing between the leads. Automated assembly of the device includes the steps of sliding or inserting the resistor into the slot, inserting injection nozzles into the grooves until they are adjacent the closed end of the cylinder and injecting thermally conductive grease like material into the space between the resistor and the cylinder at the same time the nozzles are removed from the grooves, sliding a spring biased terminal into each groove until it bottoms against a respective platform and then dispensing a first sealing layer of RTV silicon in the open end of the cylinder around the two leads passing therethrough and a second layer of epoxy on top of the first layer to provide effective pull strength for the leads. If the device is assembled by hand the above procedure is modified by coating the grease like material on the resistor before sliding it into the slot. The remainder of the procedure remains the same.

BRIEF DESCRIPTION OF THE DRAWINGS

Corresponding reference characters indicate corresponding parts through the several views of the drawings.

DESCRIPTION OF A PREFERRED EMBODIMENT

Figure 4:
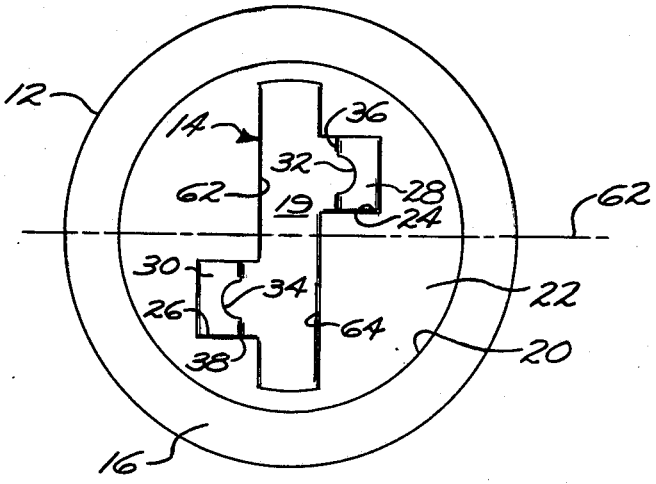
FIG. 4 is a top plan view of cylindrical body of the heater without the heater assembly.

Referring to the drawings, numeral 10 is used to generally identify a heater device made in accordance with a preferred embodiment of the invention. Heater device 10 comprises a generally cylindrical body 12 of ceramic or ceramic like material such as a molded impervious steatite in which a generally rectangular slot 14 is formed which extends from a first open end 16 of body 12 along the axis of the cylindrical body toward a second closed end 18 of body 12 terminating at surface 19. Open end 16 is formed preferably by providing a cylindrical bore 20 which extends to the surface 22 and communicates with parallelepiped slot 14. Also in communication with slot 14 are two grooves 24, 26 which extend axially from surface 22 along the length of slot 14. Although as is apparent in FIG. 4, slots 24, 26 are rectangular in cross section, they could be formed in any convenient configuration. Grooves 24, 26 have a first width and depth which extend to platforms 28, 30 respectively located intermediate the open end 16 and bottom surface 19 of body 12. Extending from platforms 28, 30 the grooves have a second configuration includig a semi-cylindrical portion 32, 34 respectively connecting with walls 36, 38 spaced from slot 14.

Figure 1:
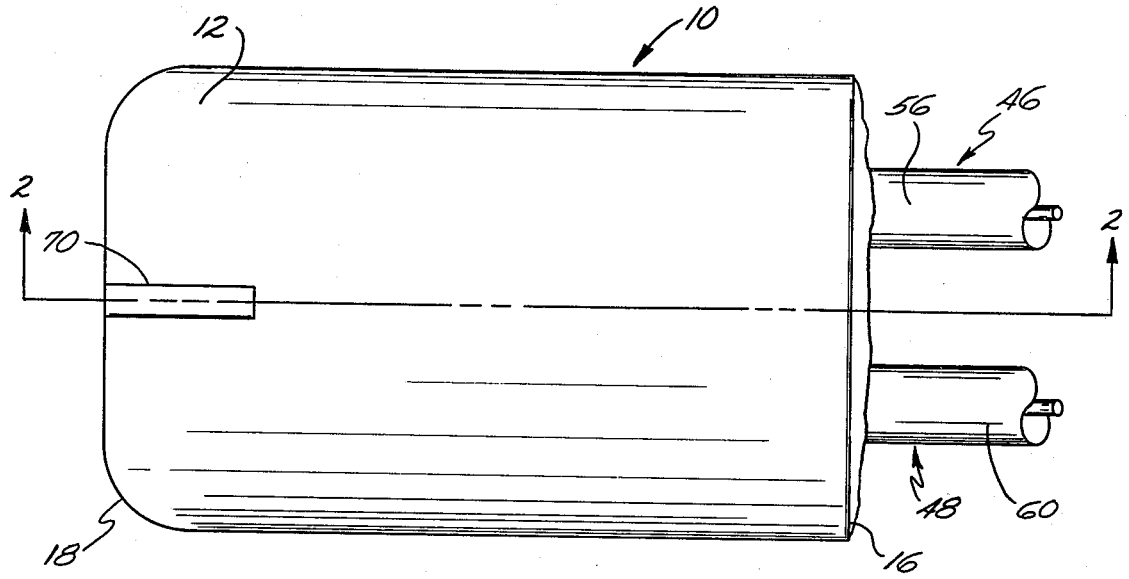
FIG. 1 is a front elevation of a heater device made in accordance with the invention.
Figure 2:
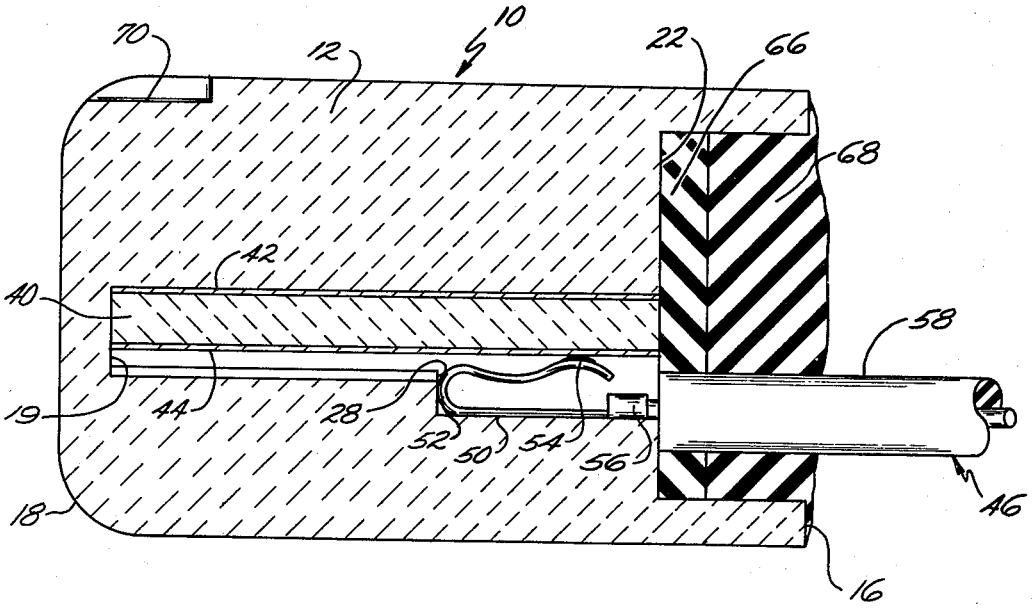
FIG. 2 is a cross sectional view taken on lines 2—2 of FIG. 1.
Figure 3:
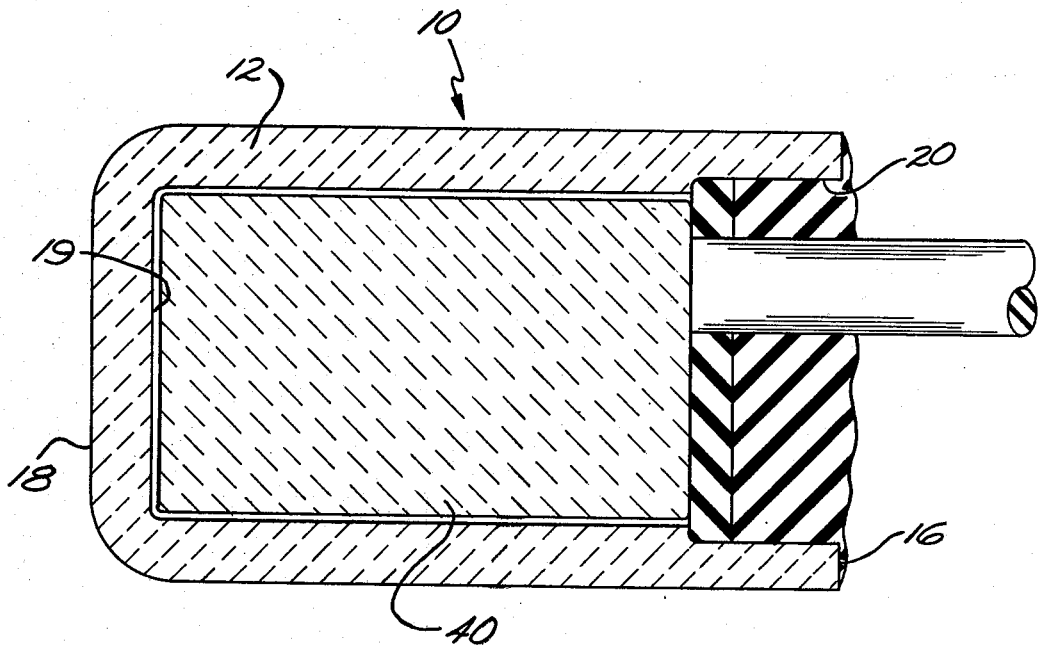
FIG. 3 is a cross sectional view similar to FIG. 2 but rotated on the axis of the cylindrical device 90° therefrom.

Resistor 40, preferably formed generally in the configuration of a parallelepiped is formed slightly smaller than and complementary with slot 14. Resistor 40 is composed of ceramic material having a positive temperature coefficient of resistivity such as barium titanate doped with a rare earth such as lanthanum and is provided with contact layers 42, 44 on opposite sides thereof. Layers 42, 44 of electrically conductive material such as electroless nickel or an inner layer of aluminum and an outer layer of copper or any other suitable material may be applied to resistor 40 in any conventional manner. Resistor 40 is disposed in slot 12 and terminals 46, 48 are provided to electrically connect resistor 40 with a power supply. As seen in FIG. 2, terminal 46 comprises a resilient electrically conductive member 50, formed of material having good electrical and spring characteristics, such as tin plated beryllium copper, clinched at 56 onto the wire lead and has an elongated strip which at 52 is bent back upon itself and with a dimple 54 formed in its distal free end which serves as the electrical contact surface biased against layer 44. In its unrestrained state, the distal end of member 50 extends further away from its base than is shown in FIG. 2 and is formed so that it will take a preselected minimum force to cause the distal end of member 50 to close. During assembly, with resistor 40 disposed in slot 12, terminal 46 is pushed into groove 24 forcing contact surface 54 to move toward the base of member 50 thereby providing sufficient contact force between contact surface dimple 56 and layer 44. The amount of insertion of terminal 46 is limited by platform 28 which reacts against portion 52. Terminal 48 is constructed in the same manner (not shown) and is received in groove 26. Terminals 46, 48 are provided with suitable electrically insulating sleeves 58, 60 respectively, such as a cross linked polyethylene. It will be noted that grooves 26, 28 are disposed on opposite sides of a plane 62 in which the axis of cylindrical body 12 lies and which is perpendicular to surfaces 62, 64 so that the outside diameter of body 12 can be kept to a minimum while still providing desired heat sink characteristics and sufficient space between sleeves 58, 60 to avoid any interference therebetween.

Heat transfer material is placed between resistor 40 and the walls of body 12 defining slot 14 to optimize heat transfer from resistor 40 to body 12. In order to avoid contamination of the side walls of bore 20 which would deleteriously affect any seal thereafter placed in the open end of the body it has been found that the heat transfer material should be curable to preclude any outgassing. By way of example, a suitable material is alcohol cured RTV 738, sold by Dow Corning Corporation, mixed with particles of aluminum oxide of varying size. The heat transfer material, which is of grease like consistency prior to curing, is either coated on resistor 40 before it is inserted in slot 14 or injected in situ as will be explained below. Once in place, the thermal transfer material is cured for up to twelve hours.

A first vapor barrier seal 66 of RTV silicone or other suitable material which is compatible with resistor 40, that is, will not deleteriously effect the PTC characteristics of the resistor is disposed in bore 20 and an epoxy seal 68 to provide required pull strength for leads from terminal 46, 48 is placed thereover. A self leveling, acetic acid cured RTV 112 sold by General Electric Company has been found to be suitable for seal 66. This is cured for approximately one hour. For seal 68 epoxy 925-13 sold by Amicon Corporation has been found to be suitable and will provide pull strength of well over twenty pounds per lead which is required in this type of device. This epoxy, after curing for approximately two hours, has the characteristic of being flexible and matches the thermal coefficient of the ceramic body. The materials used for seals 66 and 68 form both mechanical and chemical bonds with each other and with body 12.

The device and its components are configured in such a way as to facilitate automated manufacture. Groove 70 is provided in the outer surface portion of body 12 to serve as a means for orienting the body at a work station. A resistor 40 of selected base resistivity is dropped into slot 14 and injection nozzles are inserted into grooves 26, 28 and semi-cylindrical sections 32, 34 with the outlet of the nozzles in close proximity to bottom surface 19. Heat conductive but electrically insulative, curable thermal transfer grease is injected into the body in order to fill all voids between resistor 40 and body 12 to optimize heat transfer therebetween. The nozzles are withdrawn during the injection procedure so that the grease is inserted from the closed to the open end thereby avoiding trapped air pockets. Once the nozzles are completely withdrawn, terminals 46, 48 are inserted into their respective grooves and due to the spring bias of the terminals the contact surfaces wipe the grease away from the conductive layers of resistor 40 thereby making good electrical connection therewith. After allowing time for the thermal grease to cure, the silicone seal is then poured into place, allowed to cure and finally is followed by the epoxy seal which in turn is allowed to cure. Once the sealant materials have cured, the heater is ready for use.

By way of example, heaters made in accordance with the invention employed a parallelepiped PTC resistor 40 of approximately 23.8 mm × 15.0 mm × 2.5 mm with an anomaly temperature of 120° C. and a base resistivity of between 4000 - 12,700 Ω —CM @25° C. @ 240 VAC ($\frac{1}{4}$ cycle). Body 12 was 32.0 mm in length and had a diameter of 19.0 mm. Slot 14 was approximately 23.8 mm ×15.25 mm × 3.0 mm. Leads 58 and 60 were 18 gauge with a crosslinked polyethylene sleeve. The combined thickness of sealing layers 66 and 68 was approximately 5.7 mm. This size heater is particularly useful with relatively small horsepower compressors such as 1.5 to 4.5 H.P.

Thus it will be seen that the heater is easily assembled with minimal labor thereby minimizing manufacturing costs. The only difference between different voltage ratings such as 240 VRMS and 480 VRMS is in the composition of the PTC resistor material, i.e. various applied voltage levels are accomodated merely by using PTC resistors having different base resistivity levels. Thus an economy is realized both in manufacturing and in maintaining inventory since fewer different parts are required compared to prior art devices in which the design of the device is modified to accommodate different voltage levels, for instance by using PTC elements of varying thicknesses. The cylindrical shape of heater 10 not only is very efficient as a heat source enabling higher wattage per unit volume compared to heating devices with flat surfaces, it also facilitates handling and is easily receivable in a well in a crankcase. Additionally, the heater of the present invention offers an advantage in the construction of the well itself. Since the well is subjected to significant operating pressures, a cylindrical configuration is more efficient, less expensive and easier to construct than other configurations.

In view of the above, it will be seen that the several objects of the invention are achieved and other advantageous objects attained.

As various changes could be made in the above construction without departing from the scope of the invention, it is intended that all matter contained in the above description or shown in the accompanying drawings shall be interpreted as illustrative and not in a limiting sense.

We claim:

1. A self regulating electrical heater comprising a rigid body of thermally conductive, electrically insulative material having first and second end portions, the first end portion having an outer surface, a slot having an open end and a closed end formed in the body with the open end in communication with the outer surface of the first end portion and extending toward the second end portion with the closed end of the slot at the second end portion of the body, the slot defined by first two opposed surfaces joined by second two opposed surfaces, a groove having a bottom wall formed in each of said first two opposed surfaces in communication with the first end portion and extending toward the second end portion, a resistor element composed of a ceramic material with spaced, flat, electrical contact layers provided thereon disposed in the slot, the resistor element configured to slide into the slot and occupy essentially all the available space in the slot, electrically insulative, thermal transfer material disposed between the resistor element and the surfaces defining the slot filling in any remaining space, a terminal received in each groove, the terminals having electrically conductive spring means which are compressed between the bottom wall of each respective groove and a respective flat contact layer on the resistor element to provide good electrical connection with the resistor element and means sealing the slot at the first end portion with the lead attachments received therethrough.

2. A self regulating electrical heater according to claim 1 in which the grooves are coextensive in length with the slot whereby injection of thermal transfer material is facilitated.

3. A self regulating electrical heater according to claim 1 in which a plateau is formed in the grooves intermediate their ends which serves as a stop surface to limit insertion of the lead attachments.

4. A self regulating electric heater according to claim 1 in which the body is cylindrical in configuration and the first two opposed surfaces are parallel and the grooves are located on opposite sides of a plane in which the longitudinal axis of the cylinder lies and which is perpendicular to the first two surfaces.

5. A self regulating electric heater according to claim 4 further including orienting means formed in the body to facilitate automated manufacturing.

* * * * *